US006585323B2

(12) United States Patent
Gaylord et al.

(10) Patent No.: US 6,585,323 B2
(45) Date of Patent: Jul. 1, 2003

(54) SLING CHAIR

(76) Inventors: Robert E. Gaylord, 1628 Duke of Windsor Rd., Virginia Beach, VA (US) 23454; Oliver Wang, Unit 1013, China-Chen, Golden Plaza, 77 Mody Rd., T.S.T.East, Kowloon (HK)

( * ) Notice: Subject to any disclaimer, the term of this patent is extended or adjusted under 35 U.S.C. 154(b) by 0 days.

(21) Appl. No.: 09/960,525

(22) Filed: Sep. 24, 2001

(65) Prior Publication Data

US 2002/0084687 A1 Jul. 4, 2002

Related U.S. Application Data

(63) Continuation of application No. 09/551,833, filed on Apr. 18, 2000, now Pat. No. 6,293,624.

(51) Int. Cl.[7] ..... A47C 7/00
(52) U.S. Cl. ..... 297/440.11; 297/452.13
(58) Field of Search ..... 297/440.11, 440.1, 297/440.2, 445.1, 452.11, 452.12, 452.13, 452.19, 452.18, 452.2

(56) References Cited

U.S. PATENT DOCUMENTS 4,234,226 A * 11/1980 Colby
4,904,022 A * 2/1990 Morozzi
5,094,507 A * 3/1992 Gibbs
5,224,507 A * 7/1993 Vosse
5,318,348 A * 6/1994 Hess
5,407,250 A * 4/1995 Prince et al.
5,716,101 A * 2/1998 Frinier et al.
5,762,403 A * 6/1998 Robinson
5,911,478 A * 6/1999 Goodman

* cited by examiner

*Primary Examiner*—Milton Nelson, Jr.
(74) *Attorney, Agent, or Firm*—Merek, Blackmon & Voorhees

(57) ABSTRACT

A sling chair having side rails which connect to a cross member spanning the side rails. Each side rail has an extension bearing a socket which accepts insertion of one end of the cross member. The chair has a fabric seating member retained conventionally to the side rails. The cross member and side rails provide both a structural frame for the sling chair as well as a frame for the fabric seating member. The novel construction reduces the traditional redundant separate chair and sling frames to one frame.

17 Claims, 3 Drawing Sheets

SLING CHAIR

This application is a con't to U.S. patent application Ser. No. 09/551,833, U.S. Pat. No. 6,293,624, filed Apr. 18, 2000 entitled Sling Chair which is hereby incorporated by reference.

BACKGROUND OF THE INVENTION

1. Field of the Invention

The present invention relates to sling chairs, and more particularly to a sling chair wherein the side rails are adapted to attach to a cross member spanning both side rails. This eliminates the need for separate chair and web frames.

2. Description of the Prior Art

Informal outdoor furniture, particularly of the type intended for use on decks and patios, has become quite popular. Manufactures of such furniture are called upon to offer practical, comfortable products to the consumer. Because outdoor furniture is subjected to the weather, it is not feasible to employ cushions to attain desired comfort. Cushions are subject to retaining water from rain and dew, dust, pollen, and other contaminants, and to become malodorous and discolored as a consequence.

To avoid reliance upon cushions, the prior art has developed furniture such as a chair, on which a supporting web is suspended on a frame which is in turn suspended on a frame of the chair. The sling frame is removable from the chair, which is known as a sling chair. This construction arose since it is easier and less expensive to construct the sling and chair frame separately. Examples of sling chairs are seen in U.S. Pat. Nos. 5,716,101, issued to Richard D. Frinier et al. On Feb. 10, 1998, and 5,911,478, issued to Lloyd Goodman on Jun. 15, 1999. These prior art sling chairs lack a side rail adapted to receive and retain a cross member spanning both side rails, while also retaining a fabric seating member, as seen in the present invention. Other chair designs include those shown in U.S. Pat. Nos. 4,234,226, issued to Donald B. Colby on Nov. 18, 1980, and 5,094,507 and 5,224,760, both issued to Terence Gibbs respectively on Mar. 10, 1992. These prior art sling chairs lack side rails adapted to receive and retain a cross member spanning both side rails, while also retaining a fabric seating member, as seen in the present invention.

Prior art conventional sling chair construction arose since it is easier and less expensive to construct the sling and chair frame separately. However, it is apparent that conventional construction of sling chairs entails costly duplication. There remains a need to simplify construction of sling chairs, in particular, to eliminate duplicative members. None of the above inventions and patents, taken either singly or in combination, is seen to describe the present invention as claimed.

SUMMARY OF THE INVENTION

The present invention sets forth a construction for an outdoor chair of the type known as sling chairs, wherein a fabric seating member is stretched taut between and retained by entrapment within side rails. The novel construction eliminates the need for separate sling frame and chair frame, which redundancy typifies prior art sling chair design. This advance in the art is accomplished by providing side rails adapted to accept cross members which span and space apart the two side rails. The side rails retain the stretched fabric web in conventional manner, but also connect to the cross members, thereby integrating the frame of the fabric seating member and the frame of the chair.

Each side rail has a conventional keyhole shaped slot extending along the length of the side rail. The seating member is entrapped in the slot by a rod in conventional manner. In a departure from conventional slings, the side rail extends beyond the slot, the extension having sockets for accepting the ends of each cross member. During assembly, the side rails are spread apart until the cross members are inserted into engagement with the side rails. The side rails are released from separation when the cross members are in place. Tension from the fabric then maintains the side rails and cross members in place. The side rails and cross member are thus integral with the frame of the chair. The chair is completed by installation of a front piece connecting the formerly unconnected ends of the side rails, and by attaching legs if desired.

This construction eliminates the usual duplication of sling and main frames. Fewer parts must be manufactured, held in inventory, and assembled. Costs of manufacturing and consequent cost to the consumer are therefore commensurately reduced.

Accordingly, it is one object of the invention to eliminate separate sling frame and chair frame in a sling chair.

Another object of the invention is reduce complexity and cost of manufacture of sling chairs.

Still another object of the invention is to form a sling chair wherein the side rails form part of the frame of the chair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
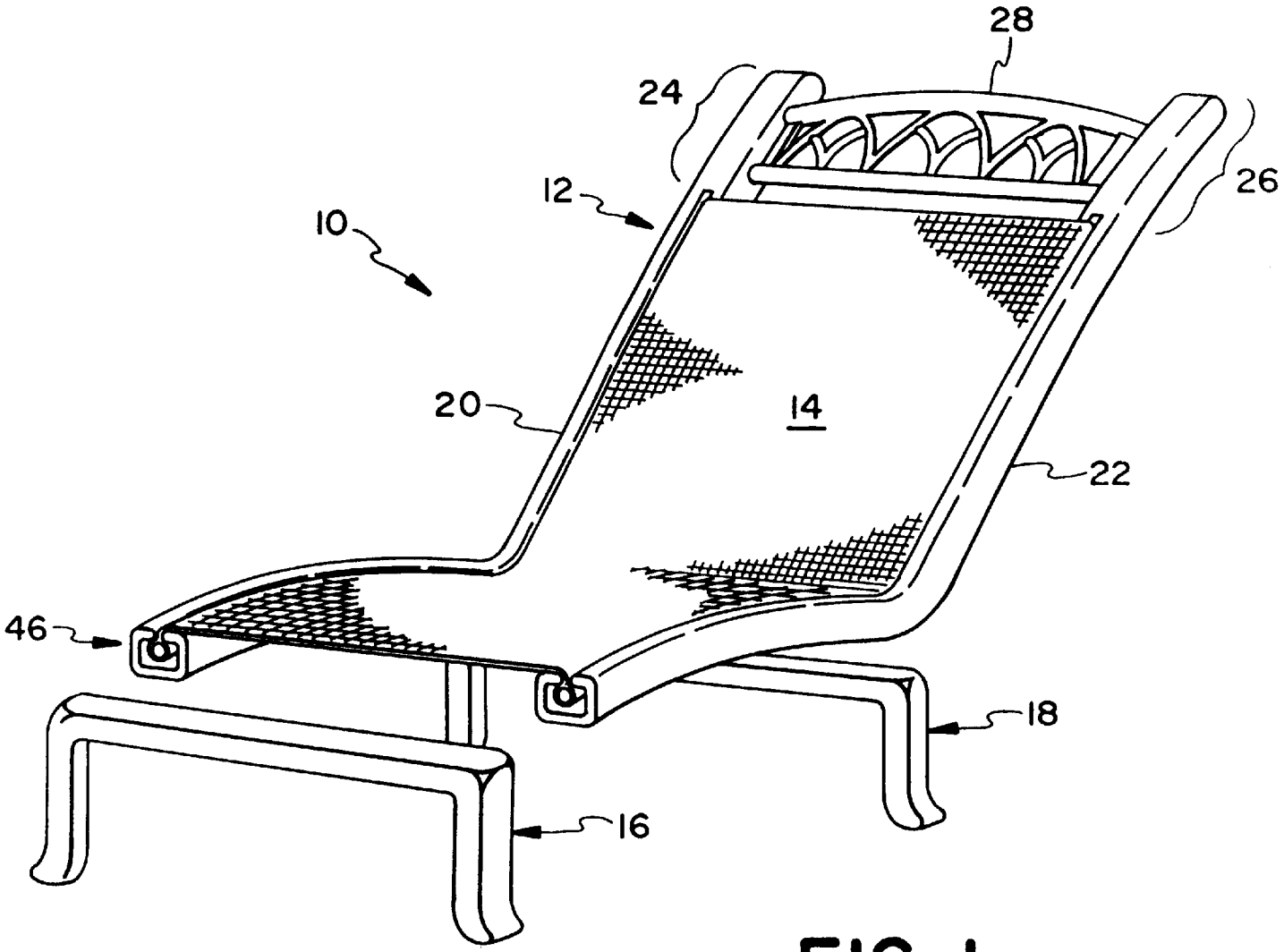
FIG. 1 is a partially exploded, front perspective view of one embodiment of the present invention.

FIG. 1 shows a sling chair 10 fabricated according to the present invention. Chair 10 has a sling frame 12, a fabric seat and seatback panel 14, a front leg assembly 16, and a rear leg assembly 18. Leg assemblies 16, 18 are connected to frame 12 in any suitable way such that the individual legs project downwardly from frame 12. For example, leg assemblies 16, 18 may be bolted to frame 12.

Sling frame 12 engages fabric panel 14 by entrapment in the conventional manner of a sling chair. Namely, fabric panel 14 is maintained under tension imposed over its width as it spans side rails 20, 22. Side rails 20, 22 thereby engage and support fabric panel 14, and also extend upwardly beyond fabric panel 14. Those portions of side rails 20, 22 extending beyond fabric panel 14, which will be termed extensions 24, 26, engage a rigid cross member 28. Cross member 28 is both ornamental and also performs a structural function. Namely, cross member 28 holds side rails 20, 22 in spaced apart relation. Sling frame 12 is supported above a floor or ground by leg assemblies 16, 18. Front leg assembly 16 serves the further function of closing the open ends of side rails 20, 22 after fabric panel 14 has been secured to each side rail 20, 22.

Figure 2:
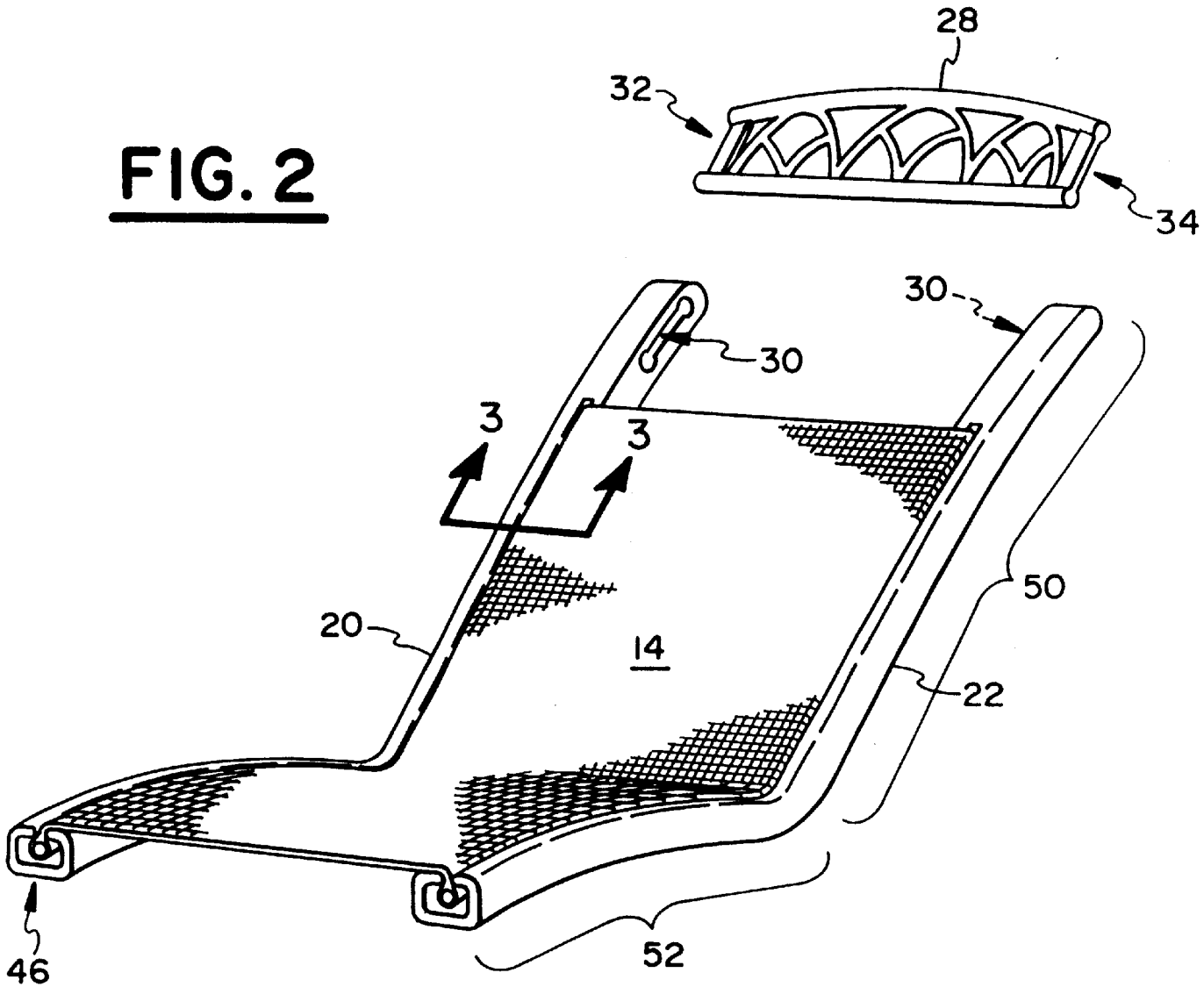
FIG. 2 is a partially exploded, front perspective detail view of the frame of the embodiment of FIG. 1.

FIG. 2 shows how frame 12 is formed. Each extension 24 or 26 of side rail 20 or 22 has a socket 30 formed in the interiorly facing surface of the respective side rail 20 or 22. Socket 30 opens to the interior side of its associated side rail 20 or 22, and is dimensioned and configured to cooperate with one end of cross member 28 to be received in close cooperation by each socket 30. Cross member 28 has length at least as great in magnitude as the width of fabric seat panel 14, so that after assembly in the configuration shown in FIG. 1, seat panel 14 is maintained under sufficient tension as to provide a slightly resilient supporting surface for a person seated on chair 10. Cross member 28 has a first end 32 and a second end 34 dimensioned and configured to be received in close cooperation by sockets 30. In the embodiment of FIG. 2, socket 30 and ends 32, 34 are configured other than as circular, thereby serving as keys opposing rotation of cross member 28 within sockets 30. However, exact configuration of ends 32, 34 and of sockets 30 is not critical provided that frame 12 will maintain the assembled condition shown in FIG. 1.

Figure 3:
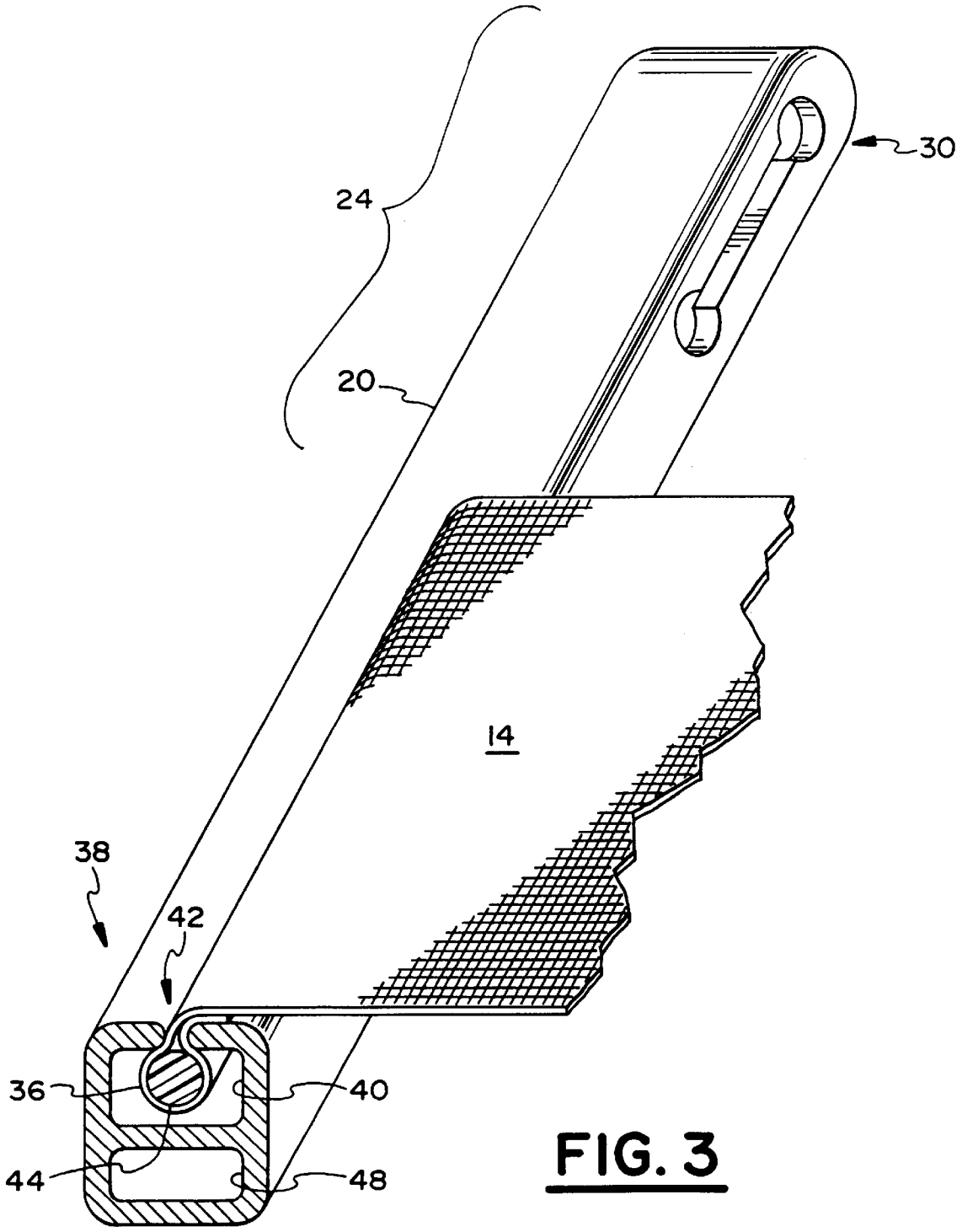
FIG. 3 is an enlarged perspective detail view taken along line 3—3 of FIG. 2.

FIG. 3 shows details of how fabric panel 14 is retained on side rails 20, 22. It will be recalled from FIG. 2 that fabric panel 14 spans side rails 20, 22. The dimension between side rails 20, 22 corresponds to the width of fabric panel 14. Examination of FIG. 3 shows that fabric panel 14 terminates at its left end in a loop 36. Loop 36 is passed through a keyhole shaped slot 38 forming an open channel in side rail 20. Slot 38 is keyhole shaped in that when viewed in cross section, as shown in FIG. 3, it includes a relatively wide section 40 and a relatively narrow neck section 42 which passes entirely through the wall of side rail 20, thereby allowing only relatively thin materials to pass therethrough. The overall visual effect of slot 38 is that of a keyhole. Only neck section 42 is exposed at the exterior of side rail 20, wide section 40 being entirely contained within side rail 20. Neck section 42 is in communication with wide section 40 so that loop 36 and an associated rod 44 occupy section 40 while the thin portion of fabric panel 14 has egress from slot 38.

Flexible dowel or rod 44 is passed through loop 36 by inserting rod 44 through the open end 46 (see FIG. 1) of side rail 20. The end of fabric panel 14 including loop 36 is thereby entrapped within side rail 20 because neck section 42 is dimensioned and configured to be too small to pass rod 44. Slot 38 extends longitudinally along side rail 20 for the length of fabric panel 14.

Chair 10 is bilaterally symmetrical, in that fabric panel 14 terminates in loops at opposing sides, there being a loop (not shown in FIG. 3) similar and corresponding to loop 36 at the right side of panel 14, as depicted in FIG. 2. Therefore, it will be understood that side rail 22 and its associated loop formed in fabric panel 14 are generally a mirror image of corresponding components shown in FIG. 3.

In the preferred embodiment, side rail 20 has two channels formed therein. One channel is formed by slot 38. The other channel 48 is provided to reinforce side rail 20 against forces which would act to distort side rail 20 when a person (not shown) sits in chair 10. Channel 48 has walls which increase area of side rail 20 in two orthogonal directions. The hollow center of channel 48 minimizes weight of side rail 20.

The present invention is susceptible to variations and modifications that may be introduced thereto without departing from the inventive concept. For example, slots formed in the side rails could open to sides other than the upwardly exposed side, as depicted herein. The fabric seat and seatback panel could, if desired, comprise a seat only or alternatively, could be provided as separate seat and seatback sections. The invention could be utilized to provide a seatback only in furniture incorporating a conventional seat. Alternatively stated, sling construction may be mixed with conventional constructions, wherein either the seat or seatback utilizes the novel integral sling frame while the other member of the seat or seatback is conventional in its construction, having a conventionally suspended cushion (not shown), for example. In further examples, the legs may be modified from the embodiment depicted. The legs could even be omitted if desired. For example, side rails 20, 22 could incorporate downwardly oriented projections serving in place of separate legs. In this embodiment, the seat would be supported above but in close proximity to the ground.

It will further be appreciated that designation of furniture as fitting into categories such as chairs, lounges, and other separate and distinct varieties may be inadequate in that, particularly with informal furniture styles such as "patio" furniture, furniture designs may show no clear delineation separating these categories. As an example, it will be seen that in the embodiments shown herein, side rails 20, 22 of frame 12 are configured to form a seat back 50 (see FIG. 2) disposed at an obtuse angle to seat section 52 (see FIG. 2). However, other configurations may enjoy the benefits of the invention. If the frame were modified such that the side rails were straight, for example, then the resulting furniture could be regarded as a cot or bed as well as a chair, lounge, sofa, or the like.

Therefore, the present invention will be understood to encompass chairs, lounges, and all manner of furniture having a seat, with or without a seatback, wherein the user is supported above the ground or a floor. Illustration of the invention as incorporating elements such as separate legs and a seat back is exemplary only and is not intended in a limiting sense. The novel furniture could incorporate elements not specifically shown, such as armrests, trays, footrests, and others.

It is to be understood that the present invention is not limited to the embodiments described above, but encompasses any and all embodiments within the scope of the following claims.

We claim:

1. A sling chair comprising a frame and a fabric seat panel having a width and terminating in loops at opposing sides for attaching said fabric seat panel to said frame, wherein said frame comprises:

a first side rail and a second side rail defining a seat;

each said first and second side rail having walls defining an open, longitudinal channel therein, said longitudinal channel having a longitudinal neck section defined by at least one of said side rail walls and an interior pocket section formed within aid walls of said side rail, and said interior pocket section in with and having a width greater than said neck communication and trapping said fabric seat panel loop therein;

each said first and second side rail further having an extension section defining a socket therein, wherein said extension section extends beyond said longitudinal channel defined in said side rail and said socket opens to an interior side of its associated said side rail; and a rigid cross member having a first end and a second end, wherein each one of said first end and said second end of said cross member is dimensioned and configured to be received in close cooperation by one of said sockets.

2. The sling chair according to claim 1, further comprising at least one leg connected to said first rail and said second rail, wherein said leg projects downwardly from said frame.

3. The sling chair according to claim 1, herein each said socket of each said side rail has a key shaped configuration to oppose rotation of said cross member in said socket.

4. The sling chair according to claim 1, wherein said side rails are configured to form a seat back disposed at an obtuse angle to said seat.

5. The sling chair according to claim 1, wherein said extension section is solid.

6. A sling chair comprising a frame for receiving a fabric seat panel having a width and terminating in loops at opposing sides for attaching the fabric seat panel to said frame, wherein said frame comprises:

a first side rail and a second side rail;

each said first and second side rail having walls defining an open, longitudinal C-shaped channel therein for receiving and trapping the fabric seat panel loop therein;

each said first and second side rail further having an extension section defining at least one socket therein, wherein said extension section of said side rail extends beyond said longitudinal C-shaped channel and said socket opens to an interior side of its associated said side rail; and a rigid cross member having a first end and a second end, wherein each one of said first end and said second end of said cross member is dimensioned and configured to be received in close cooperation by one of said sockets.

7. The sling chair according to claim 6, wherein each said socket of each said side rail has a key shaped configuration to oppose rotation of said cross member in said socket.

8. The sling chair according to claim 6, wherein said extension section is solid.

9. The sling chair according to claim 6, further comprising at least one leg connected to said first rail and said second rail, wherein said leg projects downwardly from said frame.

10. The sling chair according to claim 9, wherein said side rails are configured to form a seat and a seat back disposed at an obtuse angle to said seat.

11. A sling chair comprising a frame and a fabric seat panel having a width and terminating in loops at opposing sides for attaching said fabric seat panel to said frame, wherein said frame comprises:

a first side rail and a second side rail defining a seat;

each said first and second side rail having walls defining a interior pocket section within each said side rail;

said first side rail further having a longitudinal neck section opening defined by at least one of said first side rail walls in communication with the exterior of said first side rail and in communication with said first side rail interior pocket section for receiving and trapping said fabric seat panel loop therein;

said first side rail further having an extension section defining a socket therein, wherein said extension section extends beyond said longitudinal opening defined in said first side rail and said socket opens to an interior side of said first side rail; and said second side rail further having a longitudinal neck section opening defined by at least one of said second side rail walls in communication with the exterior of said second side rail and in communication with said second side rail interior pocket section for receiving and trapping said fabric seat panel loop therein;

said second side rail further having an extension section defining a socket therein, wherein said extension section extends beyond said longitudinal opening defined in said second side rail and said socket opens to an interior side of said second side rail; and a rigid cross member having a first end and a second end, wherein said first end and said second end of said cross member are dimensioned and configured to be received in close cooperation by a respective one of said sockets.

12. The sling chair according to claim 11, wherein said interior pocket section of said first side rail extends into at least a portion of said extension section.

13. The sling chair according to claim 11, wherein said interior pocket sections of each of said first and second side rails extend into at least a portion of said respective extension section.

14. The sling chair according to claim 11, further comprising at least one leg connected to said first rail and said second rail, wherein said leg projects downwardly from said frame.

15. The sling chair according to claim 11, wherein said side rails are configured to form a seat back disposed at an obtuse angle to said seat.

16. The sling chair according to claim 11, wherein each said socket of each said side rail has a key shaped configuration to oppose rotation of said cross member in said socket.

17. The sling chair according to claim 11, wherein an extension section is solid.

* * * * *